United States Patent [19]

Dofel

[11] Patent Number: 4,521,013

[45] Date of Patent: Jun. 4, 1985

[54] RESILIENT TYPE EXERCISING DEVICE

[75] Inventor: Andrew W. R. Dofel, Castle Hill, Australia

[73] Assignee: Supafit Gymnasium Equipment Pty. Ltd., Castle Hill, Australia

[21] Appl. No.: 476,355

[22] Filed: Mar. 17, 1983

[30] Foreign Application Priority Data

Apr. 8, 1982 [AU] Australia ..... PF3538
Oct. 7, 1982 [AU] Australia ..... PF6240
Nov. 9, 1982 [AU] Australia ..... PF6716

[51] Int. Cl.[3] ..... A63B 21/04

[52] U.S. Cl. ..... 272/136; 272/143; 272/142

[58] Field of Search ..... 272/136, 138, 142, 143, 272/135, 71, 76, 73, 131, 900, 135

[56] References Cited

U.S. PATENT DOCUMENTS 685,788 11/1901 McFadden ..... 272/136
754,992 3/1904 Grabner ..... 272/136 X
807,670 12/1905 Grabner ..... 272/136 X
2,456,017 12/1948 Park ..... 272/142 X
3,162,442 12/1964 Karlik ..... 272/136 X
3,471,146 10/1969 Drakulich ..... 272/138
4,072,309 2/1978 Wilson ..... 272/136
4,328,965 5/1982 Hatfield ..... 272/142 X
4,384,715 5/1983 Savio et al. ..... 272/136

FOREIGN PATENT DOCUMENTS 627842 7/1927 France ..... 272/136
2048085 12/1980 United Kingdom ..... 272/138

*Primary Examiner*—Richard J. Apley
*Assistant Examiner*—William R. Browne
*Attorney, Agent, or Firm*—Herbert L. Boettcher

[57] ABSTRACT

A mechanical resistance assembly employs a resilient strap which is stretched by the use of a pulley system pulled by the user. The assembly has an adjustable mechanical advantage and in a preferred use thereof being selectively coupled to a rigid, stable frame in any one of a variety of different configurations permitting a corresponding variety of different exercises to be performed by the user, some with the aid of a lever fulcrummed to the frame, but being usable also when attached to a door jamb and door or to a wall stud.

15 Claims, 17 Drawing Figures

10
11
12
29
30
35
36

RESILIENT TYPE EXERCISING DEVICE

The present invention relates to exercise devices and more particularly but not exclusively to multi-purpose exercise devices.

Exercise devices used to exercise, strengthen and tone various specific muscles of the body include specific devices designed to either exercise the legs or arms. Other devices are designed to perform several of these tasks. Such devices are described in U.S. Pat. No. 3,677; 733,170; 511,251; 2,397,054; 2,128,332; 4,072,309 and 4,231,568, employ a spring or elastic member to provide a resistance against which the user exercises. However it is a disadvantage of these previous systems that they do not provide a wide range of exercise positions and/or adjustability of the resistance.

An alternative to the above devices uses a wall mounted pulley system having weights. Although such devices are adapted to vary the resistance, such devices are not portable and do not provide for a wide range of exercise positions.

It is the object of the present invention to overcome or substantially ameliorate the above disadvantages.

There is disclosed herein a resistance assembly for an exercise device comprising, a hollow elongated casing; a first pulley mounted in one end of the casing so as to be rotatable about a fixed axis extending generally transverse of the casing; a second pulley mounted in said casing adjacent said one end but spaced longitudinally of the casing from said first pulley towards the other end of the casing, said second pulley being mounted for rotation about a fixed second axis extending generally transverse of the casing; a carriage mounted within the casing and movable longitudinally thereof so as to be movable from adjacent said other end to said one end, a third and a fourth pulley rotatably mounted on said carriage about axes which extend generally transverse of said casing, a cable extending outwardly from within said casing after passing around said first pulley, said cable having an end fixed to said casing and then passing around said pulleys to that upon said cable being pulled from within said casing said carriage is moved toward said one end, an elongated resilient member extending from said other end to said carriage so as to be tensioned by movement of said carriage from said other end, and wherein said casing is provided with a first longitudinal slot through which a portion of said carriage projects to be located externally of said casing, and said resilient means is located externally of said casing and is attached to said carriage portion.

There is further disclosed herein an exercise device having a generally rigid frame with a ground engaging base and a post extending generally upwardly from the base, a resistance assembly comprising a hollow elongated casing, a pulley system mounted within the casing and including a cable extending therefrom and outwardly of the casing, a carriage mounted within the casing and movable longitudinally within the housing by operation of the pulley system, and a resilient member attached to said carriage and said casing so that movement of said carriage in a predetermined direction tensions said resilient member, and wherein said resistance assembly is mountable in several alternative positions on said base or post to enable a user to perform a variety of exercises by pulling on said cable to thus tension said resistance member.

A preferred form of the present invention will now be described by way of example with reference to the accompanying drawings wherein.

Figures 1, 2, 3, 4, 5:
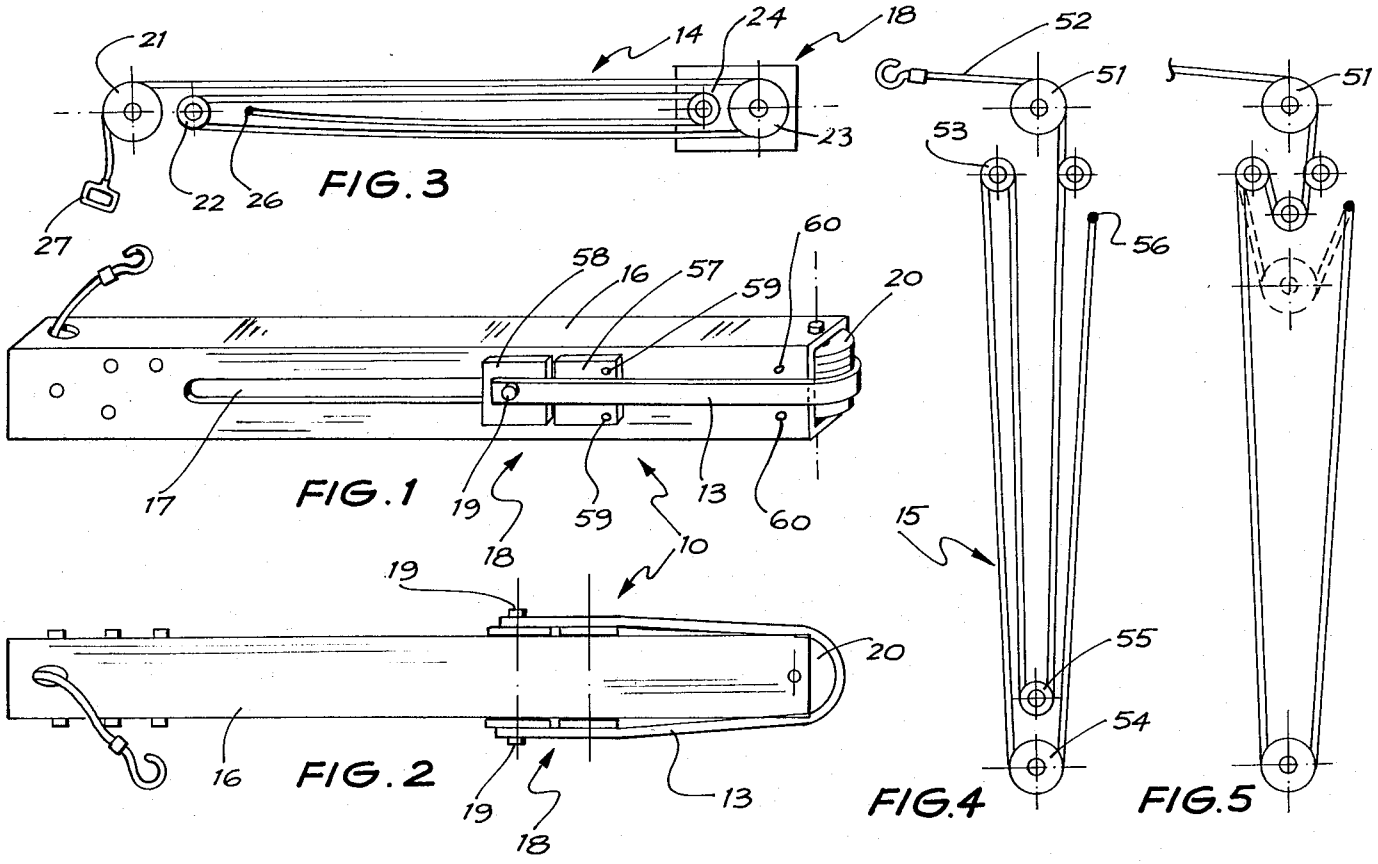
FIG. 1 is a schematic perspective view of a resistance assembly to be used in an exercise device.
FIG. 2 is a schematic plan view of the resistance assembly of FIG. 1.
FIG. 3 is a schematic view of a first pulley system to be employed in the resistance assembly of FIG. 1.
FIG. 4 is a schematic view of an alternative pulley system to be employed in the resistance assembly of FIG. 1.
FIG. 5 is a schematic view of the pulley system of FIG. 4 with the cable of the pulley system extended from the resistance assembly.
Figures 6, 7:
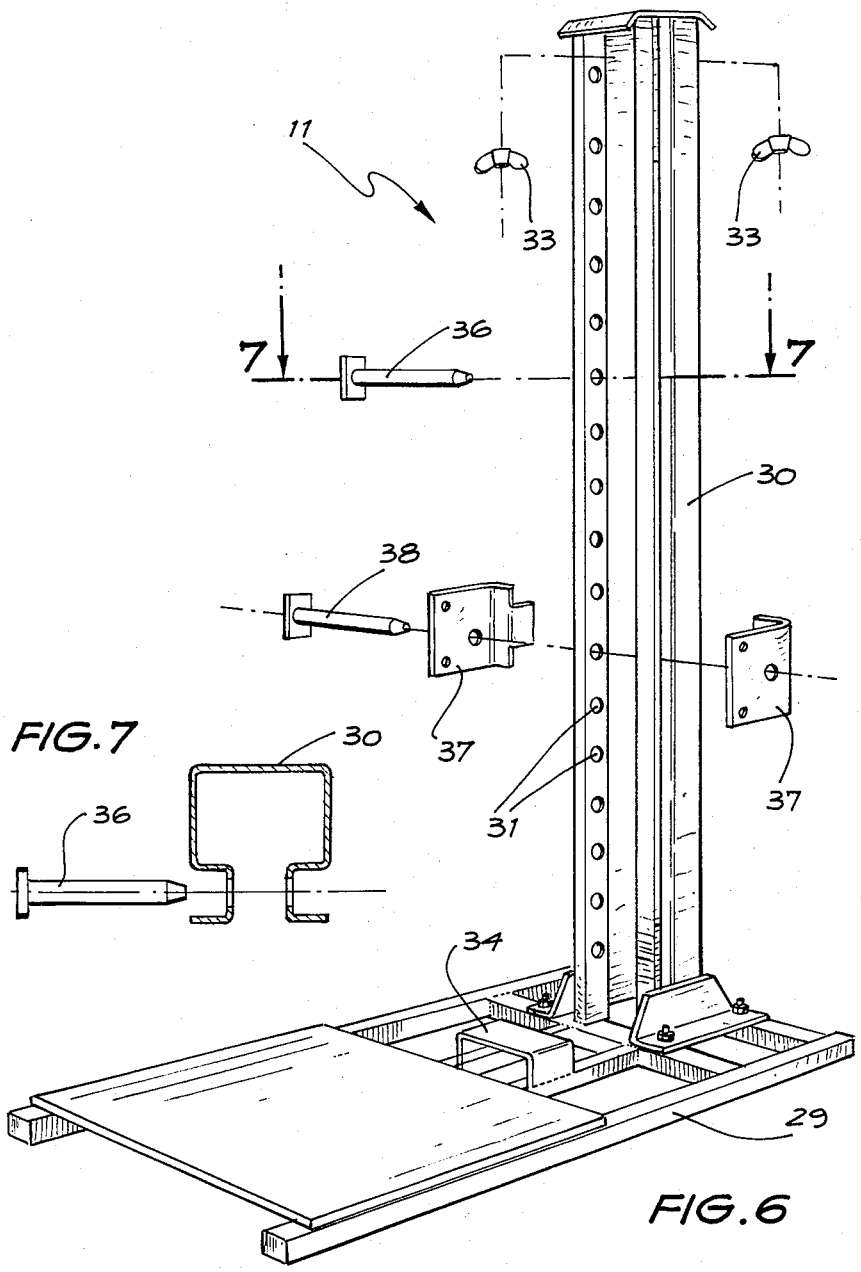
FIG. 6 is a schematic perspective view of a frame to employ the resistance assembly of FIG. 1.
FIG. 7 is a schematic sectioned plan view of the frame of FIG. 6 sectioned along the line 7—7.
Figure 15:
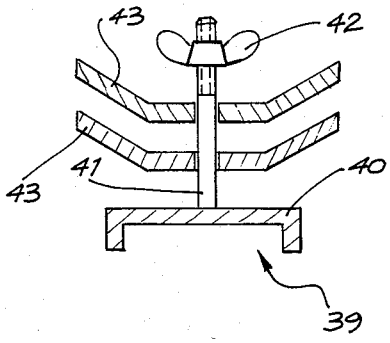
Figure 13:
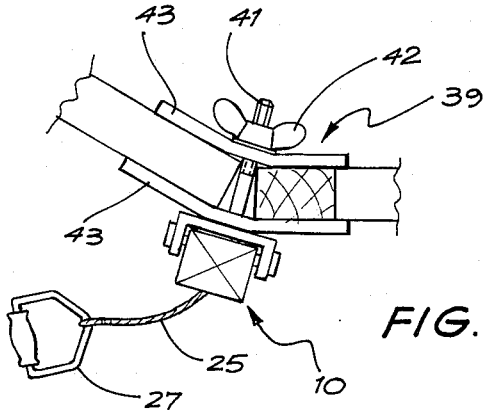
Figure 14:
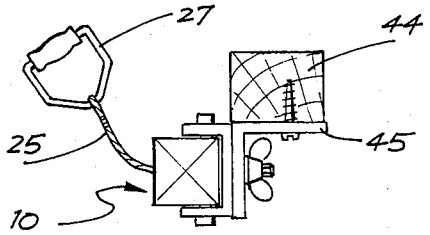
Figure 17:
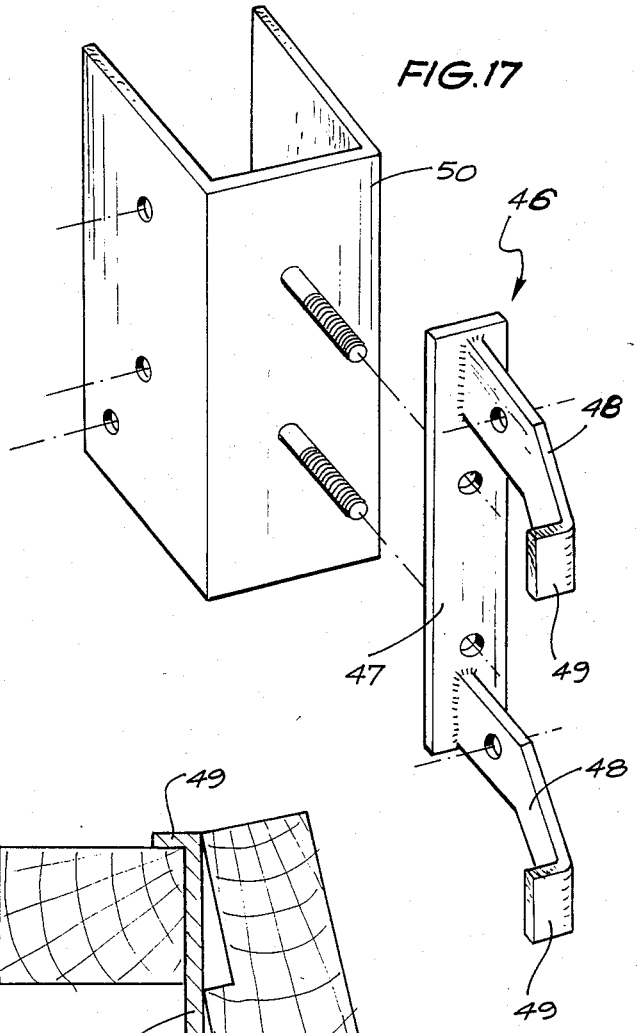
Figure 16:
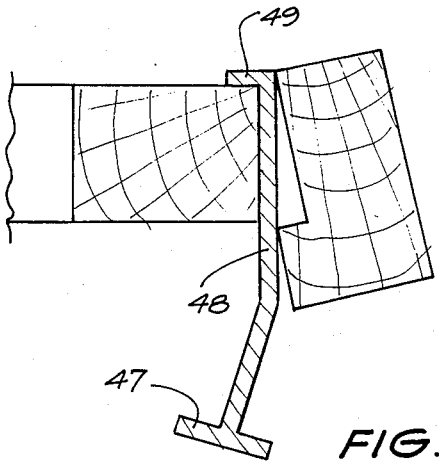

FIGS. 8 to 12 schematically illustrate in use the resistance assembly of FIG. 1 mounted on the frame of FIG. 6;

FIG. 13 is a schematic plan view of the resistance assembly of FIG. 1 fixed to a door and door jamb;

FIG. 14 is a schematic plan view of the resistance assembly of FIG. 1 mounted to a wall stud;

FIG. 15 is a schematic plan view of an attachment employed to couple the resistance assembly of FIG. 1 to a door and door jamb as illustrated in FIG. 13;

FIG. 16 is a schematic plan view of an alternative attachment for coupling the resistance assembly of FIG. 1 to a door and door jamb; and FIG. 17 is a schematic perspective view of the attachment of FIG. 16 with a bracket to engage the resistance assembly of FIG. 1.

In FIGS. 1 and 2 there is schematically depicted a resistance assembly 10 which is to be coupled to a frame 11 (FIG. 6) so that a user may construct the exercise device 12 of FIGS. 8 to 12 and use the exercise device 12 in the various configurations as illustrated.

The resistance assembly 10 of FIGS. 1 and 2 employs an elongated resilient strap 13 which is stretched by means of a pulley system pulled by a user of the exercise device 12. In FIGS. 3 and 4 there are depicted two alternative pulley systems 14 and 15 however it should be appreciated that other pulley system configurations are envisaged. Initially the resistance assembly 10 will be described as employing the pulley system 14. The resistance assembly 10 includes a casing 16 which is hollow and elongated and may be constructed of sheet metal or plastic provided the material employed gives the casing 16 sufficient rigidity. Two opposite sides of the casing 16 are provided with a slot 17. Slidably mounted within the casing 16 is a carriage 18 which also projects through the slots 17 to enable attachment to the carriage 18 of the strap 13. More specifically the carriage 18 would have an exposed spigot 19 extending through each of the slots 17. The strap 13 would be provided with an eyelet at each end to enable attachment of the strap 13 to the exposed spigots 19. Also mounted in the casing 16 is an end roller 20 about which the strap 13 passes.

The pulley system 14 mounted within the casing 16 includes a first pulley 21 rotatably supported by the casing so as to be rotatable about a fixed transverse axis. The pulley system 14 further includes a second pulley 22 also fixed to the casing 16 so as to be rotatable about an axis extending generally transverse of the casing 16.

Mounted on the carriage 18 so as to be movable therewith is a third pulley 23 and a fourth pulley 24 also rotatable about axes extending generally transverse of the casing 16. Extending around the pulleys 21 to 24 is a cable 25 which has one end 26 fixed to the casing 16 while the other end is provided with a handle or hook 27.

In operation of the above described resistance assembly 10, a user of an exercise device to which the assembly 10 is connected applies a force to the hook or handle 27 to thereby cause movement of the carriage 18. Movement of the carriage 18 towards the pulley 21 causes tensioning of the strap 13 to thereby provide a resistance to movement of the cable 25.

The resistance assembly 10 may for example be adapted to be employed with the frame 11 of FIGS. 6 and 7. The frame 11 includes a base 29 to which is fixed a vertical post 30. The base 29 and post 30 are preferably formed of rigid material such as steel and are fixed together so that movement of the post 30 relative to the base 29 is inhibited. The post 30 is formed so as to have a cross-section as depicted in FIG. 7 and is provided with a plurality of passages 31 to receive the pin 36 enabling attachment of the resistance assembly 10 to various locations along the post 30 as more schematically illustrated in FIGS. 8, 9, 10 and 11. Additionally there is provided apertures at the top of the post 30 which receives studs on the resistance assembly 10 which studs are engaged by wing nuts 33 to secure the resistance assembly 10 to the frame 11 so that the resistance assembly 10 may be employed in the position more fully depicted in FIG. 8.

Figures 8, 9, 10, 11, 12:
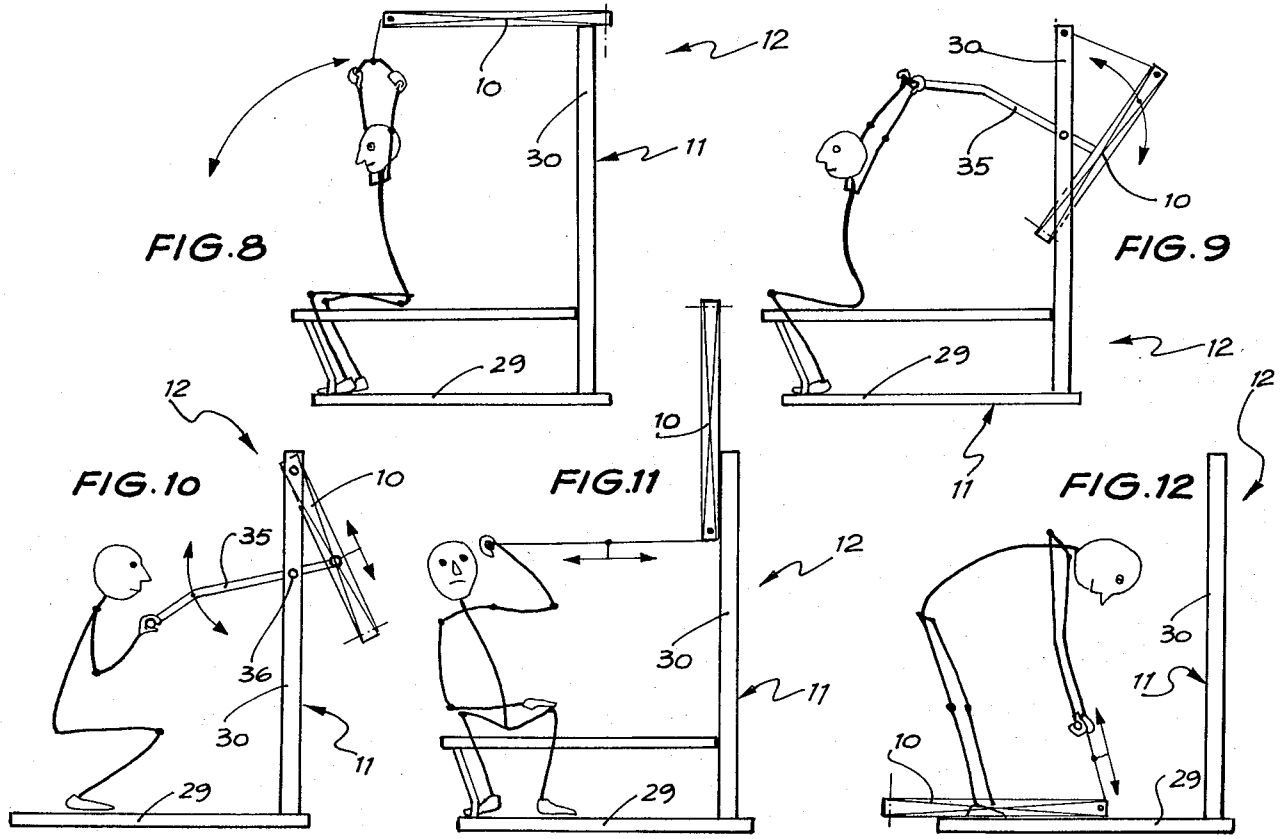

The base 29 is provided with an apertured bracket 34 enabling the resistance assembly 10 to be attached thereto so that a user may employ the resistance assembly 10 in the position more schematically depicted in FIG. 12.

As can be seen from FIGS. 9 and 10 the exercise device 12 may further include a lever 35 and pin 36 so that a user may employ the resistance assembly 10 in the configurations more fully depicted in FIGS. 9 and 10. In FIG. 9, the resistance assembly 10 has its cable pulled outwardly from its casing to place its resilient member under tension. In FIG. 10, the cable can not be seen, as it is fully retracted into the casing to remove the tension from the resilient member. There is also provided two brackets 37 and a pin 38 which enable attachment of the resistance assembly 10 to the post 30 in the configuration more fully depicted in FIG. 11.

The resistance assembly 10 may also be employed as depicted in FIGS. 13 to 15. In FIG. 13 the resistance assembly 10 is attached to a door jamb and door by means of a bracket 39. The bracket 39 is more fully depicted in FIG. 15 and includes a base 40 from which extends a threaded member 41 which receives a nut 42. Located on the threaded member 41 so as to be slidable therealong are two shaped plates 43 which are adapted to engage the door jamb and door.

In FIG. 14 the resistance assembly 10 is attached to a wall stud 44 by means of an angle bracket 45. In FIGS. 16 and 17 a still further method of attaching the resistance assembly 10 to a door and door jamb is illustrated. This further method includes a hooked member 46 having a base 47 from which extends two shaped legs 48 which have end flanges 49 which engage the door as more fully depicted in FIG. 16. Attached to the base 47 is a U-shaped adaptor 50 to which the resistance assembly 10 is attached.

Turning now to FIGS. 4 and 5 wherein an alternative pulley system 15 for use in the resistance assembly 10 is depicted. In FIG. 3 the pulley system 14 provides the user with a lever advantage of 4:1 against the strap 13. In circumstances where the pulley system 14 provides too great a travel for the hook or handle 27, an alternative pulley system 15 may be used. In FIGS. 9 and 10 where use of the lever 35 is depicted, it may be advantageous to employ a resistance assembly 10 employing the pulley system 15 of FIGS. 4 and 5.

The pulley system 15 includes a first pulley 51 which is rotatably supported by the casing 16 so as to be rotatable about an axis generally transverse of the casing 16. The cable 52 extends around the pulley 51 so as to exit from the casing 16. Also rotatably mounted in the casing 16 is a second pulley 53 which is mounted so as to also be rotatable about an axis generally transverse of the casing. Rotatably mounted on the carriage 18 is a third pulley 55 and a fourth pulley 54 which are rotatable about axes extending generally transverse of the casing 16. In this particular embodiment the cable 52 extends from the first pulley 51 around the third pulley 55 to return to the second pulley 53. From the second pulley 53 the cable 52 extends around the fourth pulley 54 to be fixed to the casing at the pin 56. The pulley system 15 may provide for a lever advantage of 4:1 in a similar manner to the pulley system 14 of FIG. 3. However the advantage may be reduced to 2:1 and the travel of the cable 52 considerably reduced by splitting the carriage 18 into two carriage parts 57 and 58. Rotatably mounted on the carriage part 58 is the pulley 55 while rotatably mounted on the carriage part 57 is the pulley 54. Additionally the carriage part 58 is provided with the spigots 19 to which the strap 13 is attached. Additionally the carriage part 57 is provided with apertures 59 through which bolts may pass to engage the threaded passages 60 in the casing 16 so that the first carriage part 57 is selectively attachable to the casing 16 so as to prevent movement thereof.

Firstly, if the first carriage part 57 is free for movement to follow the second carriage part 58, then a person applying a force via the frame 11 to the cable 52 has an advantage of 4:1 to the force being applied to the movable carriage 18 by the band 13. However if the first carriage part 57 is fixed to the casing 16 then the user applying a force to the cable 52 has a reduced advantage of 2:1 to the force being applied to the carriage 18 by the strap 13.

It should further be appreciated that the dashed lines of FIG. 5 illustrate the configuration with both the pulleys 54 and 55 free to move.

Still further to the above it should be appreciated that in the particular configuration where the second carriage part 58 is attached to the casing 16 to thereby prevent movement of the pulley 54 the exercise device 12 of FIGS. 8 to 12 may provide for full movement of the strap 13.

What I claim is:

1. A resistance assembly for an exercise device comprising: a hollow elongated casing; a first pulley mounted in one end of the casing so as to be rotatable about a first fixed axis; a second pulley mounted in said casing adjacent said one end but spaced longitudinally of the casing from said first pulley toward the other end of the casing, said second pulley being mounted for rotation about a fixed second axis; a carriage mounted within the casing and movable longitudinally thereof so as to be movable from adjacent said other end to said one end; a third and a fourth pulley rotatably mounted on the carriage; a cable extending outwardly at a first end thereof from within said casing after passing around said first pulley, said cable having a second end thereof fixed to said casing and then passing around said second, third and fourth pulleys following in such order that upon said cable being outwardly pulled at its first end from within said casing said carriage is moved toward said one end; an elongated resilient member extending from said other end to said carriage, and wherein said casing is provided with a first elongated slot through which a portion of said carriage projects to be located externally of said casing, and said resilient member is located externally of said casing and is attached to said carriage portion so as to be tensioned by movement of said carriage towards said one end from said other end.

2. The assembly of claim 1 wherein said cable extends from said first pulley, around said third pulley to said second pulley, around said second pulley to said fourth pulley, and around said fourth pulley to be fixed to said casing adjacent said one end thereof.

3. The assembly of claim 2 wherein said fourth pulley is longitudinally spaced towards said one end of said casing from said third pulley.

4. The assembly of claim 2 wherein said third pulley is longitudinally spaced towards said one end from said fourth pulley.

5. The assembly of claim 4 wherein said carriage consists of two independently movable carriage parts with said fourth pulley mounted on a first one of said carriage parts, and said third pulley is mounted on a second one of said carriage parts with said carriage portion attached to the second carriage part, and wherein the first carriage part is selectively fixable to said casing for obtaining movement toward said one end of the casing of only said second carriage part by said cable being outwardly pulled at its first end from within the casing.

6. The assembly of claim 1, 2, 3, 4 or 5 wherein said casing is provided with a second elongated slot on an opposite side of the casing to said first slot, and said carriage has a further portion which projects through said second slot, said resilient member extends around said other end of said casing so as to have both its extremities fixed to said carriage portions projecting through the slots, and said assembly further includes a roller mounted in said casing at said other end about which said resilient member passes.

7. An exercise device having a generally rigid frame with a ground engaging base and a post extending generally upwardly from the base, a resistance assembly comprising a hollow elongated casing, a carriage mounted within the casing and movable longitudinally therewithin, a resilient member attached to said carriage and said casing for developing a tensional force that resists the longitudinal movement of said carriage in a predetermined direction, and a pulley system mounted within the casing for longitudinally moving said carriage, said pulley system including a cable which extends outwardly of the casing and is looped about the carriage and which, in response to being pulled, causes the carriage to move longitudinally in said predetermined direction against said tensional force developed by said resilient member, and wherein mounting means are provided for mounting said resistance assembly in several alternative positions on said base or post to enable a user to perform a variety of exercises by pulling on said cable to thus tension said resilient member.

8. The exercise device of claim 7 further including a lever pivotally coupled intermediate its ends to said post so as to be generally horizontally oriented, and wherein said resistance assembly is attachable to said lever for enabling the user to pull said cable from within the casing by pivoting movement of said lever.

9. The exercise device of claim 8 wherein said pulley system includes a first pulley mounted in one end of the casing so as to be rotatable about a first fixed axis; a second pulley mounted in said casing adjacent said one end but spaced longitudinally of the casing from said first pulley toward the other end of the casing, said second pulley being mounted for rotation about a fixed second axis; said carriage is mounted within the casing and movable longitudinally thereof so as to be movable from adjacent said other end to said one end; a third and a fourth pulley are rotatably mounted on the carriage; said cable extends outwardly at a first end thereof from within said casing after passing around said first pulley, said cable having a second end thereof fixed to said casing and then passing around said second, third and fourth pulleys following in such order that upon said cable being outwardly pulled at its first end from within said casing said carriage is moved toward said one end; said resilient member is elongated and extends from said other end to said carriage, and wherein said casing is provided with a first elongated slot through which a portion of said carriage projects to be located externally of said carriage, and said resilient member is located externally of said casing and is attached to said carriage portion so as to be tensioned by movement of said carriage towards said one end from said other end.

10. The assembly of claim 9 wherein said cable extends from said first pulley, around said third pulley to said second pulley, around said second pulley to said fourth pulley, and around said fourth pulley to be fixed to said casing adjacent said one end thereof.

11. The assembly of claim 10 wherein said fourth pulley is longitudinally spaced towards said one end of said casing from said third pulley.

12. The assembly of claim 10 wherein said third pulley is longitudinally spaced towards said one end from said fourth pulley.

13. The assembly of claim 12 wherein said carriage consists of two independently movable carriage parts with said fourth pulley mounted on a first one of said carriage parts, and said third pulley is mounted on a second one of said carriage parts with said carriage portion attached to the second carriage part, and wherein the first carriage part is selectively fixable to said casing for obtaining movement of said one end of the casing of only said second carriage part by said cable being outwardly pulled, at its first end, from within said casing.

14. The assembly of claim 9, 10, 11, 12 or 13 wherein said casing is provided with a second elongated slot on an opposite side of the casing to said first slot, and said carriage has a further portion which projects through said second slot, said resilient member extends around said other end of said casing so as to have both its extremities fixed to said carriage portions projecting through the slots, and said assembly further includes a roller mounted in said casing at said other end and about which said resilient member passes.

15. The exercise device of claim 8 wherein said post is provided with a plurality of passages to enable attachment of said lever at a variety of heights along the post.

* * * * *